United States Patent [19]

Deane

[11] Patent Number: 4,848,489

[45] Date of Patent: Jul. 18, 1989

[54] DRAG DRILL BIT HAVING IMPROVED ARRANGEMENT OF CUTTING ELEMENTS

[75] Inventor: John D. Deane, Houston, Tex.

[73] Assignee: Reed Tool Company, Houston, Tex.

[21] Appl. No.: 270,431

[22] Filed: Nov. 7, 1988

Related U.S. Application Data

[63] Continuation of Ser. No. 103,650, Oct. 2, 1987, abandoned, which is a continuation-in-part of Ser. No. 30,123, Mar. 26, 1987, Pat. No. 4,794,994.

[51] Int. Cl.[4] ..... E21B 10/60

[52] U.S. Cl. ..... 175/329; 175/393; 175/394; 175/400; 175/410

[58] Field of Search ..... 175/329, 393, 394, 398, 175/400, 410, 377, 397

[56] References Cited

U.S. PATENT DOCUMENTS

| | | | |
|---|---|---|---|
| 2,838,284 | 6/1958 | Austin | 175/400 |
| 3,095,935 | 7/1963 | Hildebrandt et al. | 175/393 |
| 3,181,632 | 5/1965 | Raynal | 175/329 |
| 3,951,220 | 4/1976 | Phillips, Jr. et al. | 175/410 X |
| 4,350,215 | 9/1982 | Radtke | 175/329 |
| 4,475,606 | 10/1984 | Crow | 175/410 |
| 4,538,690 | 9/1985 | Short, Jr. | 175/410 X |
| 4,574,895 | 3/1986 | Dolezal et al. | 175/400 X |
| 4,682,663 | 7/1987 | Daly et al. | 175/329 |

*Primary Examiner*—Bruce M. Kisliuk

*Attorney, Agent, or Firm*—Dodge Bush & Moseley

[57] ABSTRACT

A drag type rotary bit (10) having a plurality of arcuate blades (24A–24E) each having a row of cutting elements (36A–36G) thereon. The cutting elements (36A–36G) are arranged on the arcuate blades (24A–24E) with around one-half of the length of the arcuate blades (24A–24B) being positioned adjacent the outer periphery (20) of the bit body (12) to provide a relatively long length mounting area or the cutting elements (36D–36G) at the gage (20). Deep grooves (26) are provided adjacent each of the blades (24A–24E) and provide a relatively large passage for the outwardly flow of drilling fluid and entrained cuttings.

12 Claims, 4 Drawing Sheets

DRAG DRILL BIT HAVING IMPROVED ARRANGEMENT OF CUTTING ELEMENTS

CROSS REFERENCE TO COPENDING APPLICATION

This application is a continuation of application Ser. No. 103,650 filed Oct. 2, 1987, now abandoned, which is a continuation-in-part of application Ser. No. 030,123, filed Mar. 26, 1987 now U.S. Pat. No. 4,794,994.

BACKGROUND OF THE INVENTION

This invention relates generally to drag type rotary drill bits and more particularly to the arrangement of cutting elements along curved blades and fluid discharge nozzles arranged in advance of the cutting elements.

It has become common practice to dress drag type rotary well drilling bits with cutting elements made of man made polycrystalline diamond compacts or cutters projecting from the bit body. This technology has allowed diamond cutting elements to be formed and shaped into more desirable cutting edges and has further provided higher strength diamonds allowing cutting edges to project a maximum distance from the bit body. One polycrystalline diamond cutting structure in common use has been what is commonly referred to as polycrystalline diamond compact (PDC) which is a small carbide plate with a thin layer of polycrystalline diamond bonded to one face. This has resulted in PDC type diamond drill bits capable of drilling more efficiently in softer formations than was possible with the natural diamonds used in earlier diamond bits.

The use of these PDC type diamond drill bits has also had resultant undesirable increased problems associated with heat degradation and "balling". Balling is a build up of formation chips or cuttings on the bit face or the hole bottom and is caused by sticky formations, such as sticky shales or similar formations having a large percentage of clays, adhering to the cutting face of the bit. This balling condition not only deters drilling, but it also causes rapid heat deterioration of the cutting elements due to poor circulation and decreased cutting efficiency.

This balling condition occurs primarily when using water based muds which cause a swelling of the clays. It is highly desirable to provide a bit dressed with these PDC type cutting elements which has the versatility to not only drill efficiently in soft, sticky formations when using water base muds, but also remain effective and durable when harder formations are encountered.

U.S. Pat. No. 4,499,958 discloses a deep bladed design for a drill bit using PDC type cutting elements but this design would appear to have a limited cleaning effect for the edges of the cutting elements. Also, this type bit may be subjected to considerable wear and breakage when harder formations are encountered because of the relatively small number of cutting elements and the relatively long projection of the cutting elements from the adjacent bit body or blade.

U.S. Pat. No. 4,505,342 discloses a PDC type drill bit which has a large number of cutting elements arranged on a large number of blades adjacent relatively shallow grooves, and has fluid nozzles directed at the well bore bottom. After the fluid impinges the well bore bottom a portion of the fluid flows at relatively low velocity through the fluid channels directing it in front of rows of cutting elements in an attempt to adequately flush all of the cutting elements and clean the hole bottom. The fluid velocity resulting in these channels is too low, however, for providing adequate cleaning of the cutting elements when drilling soft sticky formations with water base muds and prevent balling.

In other attempts to solve this severe cleaning problem resulting from soft sticky formations, U.S. Pat. Nos. 4,452,324; 4,471,845; 4,303,136; and 4,606,418 have disclosed PDC type diamond drill bits with relatively large numbers of nozzle orifices in the bit in an attempt to adequately clean all of the cutting elements on the bit. However, if the velocity and total orifice area are maintained a large number of nozzle orifices will result in orifices of a small area and this will increase the probability of clogging of some of the nozzle orifices. A reduced velocity will result in the event the total orifice area for the bit is increased and this likewise will increase the probability of clogging of the nozzle orifices.

SUMMARY OF THE INVENTION

The present invention is directed particularly to a drag type rotary drill bit that is adapted for drilling effectively in both hard formations and soft sticky formations. This is accomplished by the design of such a rotary drill bit having a large number or high density of cutting elements especially adjacent the outer periphery of the drill bit while utilizing a minimum number of blades. To maximize the outward flow of cuttings along the well bore bottom, relatively deep grooves are provided in the bit body adjacent the leading side of the blades thereby to facilitate the outward flow of drilling fluid with entrained cuttings immediately after the cutting action of the cutting elements against the well bore bottom.

To provide a sufficient area in which to mount the large number of cutting elements in a continuous row while using only a minimal number of blades, the relatively deep grooved blades are formed of a curved or spiral shape with several of the cutting elements being in a laterally overlapping relation to each other, particularly at the gage area, with respect to the rotational cutting path of the cutting elements. It is highly desirable to have a large number of cutting elements adjacent the gage area as this area of the bore hole has the greatest volume of formation to be removed.

Normally, bladed drag type rotary well drilling bits have utilized cutting elements made of man made polycrystalline diamond contacts or cutters projecting from the bit body. The use of polycrystalline diamond cutting elements has resulted in drilling more efficiently in certain formations than was possible with natural diamonds used in the earlier diamond bits. Usually deep bladed drag type rotary drill bits are used in drilling soft sticky clay formations with water based mud and utilize straight blades with deep grooves adjacent the blades to allow large volumes of cuttings to move away from the cutting edges of the cutting elements and be transported by the drilling fluid outwardly thereby to minimize any balling along the cutting face of the bit. However, a relatively small number of cutting elements have been provided heretofore and when harder formations are encountered, such cutting elements become heavily loaded and may fail due to overload or rapid thermal deterioration or degradation.

Also, in various formations where layers of hard, strong material are mixed with the soft sticky clays, a deep straight bladed bit has a tendency to hang up or cease rotation since a straight radial blade design rapidly digs or bites into the formation. Further, the heavy loads encountered tend to flex the straight radial blades and additional stresses are exerted on the cutting elements which can result in breaking or unbinding the cutting elements from their mounting or in fatigue cracking of the blade.

A drag type bit that is designed particularly for drilling in hard formations usually has a large number of cutting elements, particularly in the area adjacent the outer periphery or the gage area of the drill bit body. This is normally accomplished by having an increased number of rows of cutting elements to provide the large number of cutting elements but such a design is not normally effective in the soft, sticky clay formations.

It is also desirable to provide a relatively small number of fluid discharge nozzles or orifices which results in relatively large diameter ports forming the orifices thereby reducing the possibility of clogging of the orifices. Thus, a minimum number of nozzles is associated with each blade or row of cutting elements and is positioned ahead of the respective associated row in advance of or in the direction of rotation of the bit. With this arrangement, the portion of the well bore bottom immediately in the path of the cutting elements is cleaned of cuttings and the cutting elements are thereafter washed clean of cuttings in addition to being cooled by the stream of drilling fluid as the cuttings are formed by the cutting elements. The drilling fluid is discharged in a high velocity stream in a flow generally opposite the direction of rotation of the bit and in a downward conically shaped flow pattern to an area of impingement on the well bore bottom ahead of the associated row of cutting elements with the fluid flowing along with entrained cuttings from the area of impingement outwardly generally along the grooves adjacent the blades and cutting elements. For the preferred embodiment, it is desirable to utilize a single orifice or fluid discharge nozzle for each row which includes a plurality of cutting elements. The center of the volume of fluid discharged from a fluid discharge orifice which is the center of the jet formed by the discharged drilling fluid is directed against the well bore bottom immediately in the path of the row of cutting elements and a portion of the conically shaped stream impinges two or more of the cutting elements. Cutting elements preferably have planar leading cutting faces and cutting edges along the cutting faces with the cutting edges and planar faces being in a plane generally transversely of the axis of rotation of the drill bit.

The drag type rotary drill bit of the present invention includes a plurality of blades extending from a generally cylindrical bit body and spaced generally circumferentially from along the bit body. Each blade has an arcuate or curved leading side extending generally to the outer periphery of the bit body and defining a groove in the bit body adjacent the leading side with the lengt of the arcuate leading side of the blade being at least forty (40) percent greater than the corresponding straight radial distance covered by the blade and the groove adjacent the blade being relatively large depth, at least around twice the projection of the cutting element from the blade. A continuous row of cutting elements mounted on each of the blades are spaced generally radially along the length of the blade with the number of cutting elements increasing in the direction toward the outer periphery of the bit body and with several of the cutting elements being in an overlapping relation to each other with respect to the rotational path of the bit body.

It is an object of the present invention to provide a drag type rotary drill bit having a large number of cutting elements mounted on a minimal number of blades circumferentially spaced along the bit body.

It is a further object of the invention to provide such a drag type rotary drill bit utilizing a minimal number of discharge nozzles or orifices for the blades, preferably about one (1) discharge nozzle for each row of cutting elements on a blade.

An additional object of this invention is to provide such a drag type rotary drill bit in which the blades extending to the outer peripheral or gage area of the drill bit body have an arcuate leading side curved rearwardly with respect to the direction of rotation with several of the cutting elements thereon being in overlapping relation, relative to the rotational path thereof and with the number of cutting elements progressively increasing in a direction toward the gage area of the drill bit body.

Another object is to provide such a blade design for a drag type rotary drill bit in which the lower surface of the blade is generally horizontal and extends in a plane generally perpendicular to the longitudinal axis of the drill bit body and in a spiral path from an intermediate or center portion of the drill bit body to the gage thereof.

Other objects, features, and advantages of this invention will become more apparent after referring to the following specification and drawings.

DESCRIPTION OF THE INVENTION

Figure 1:
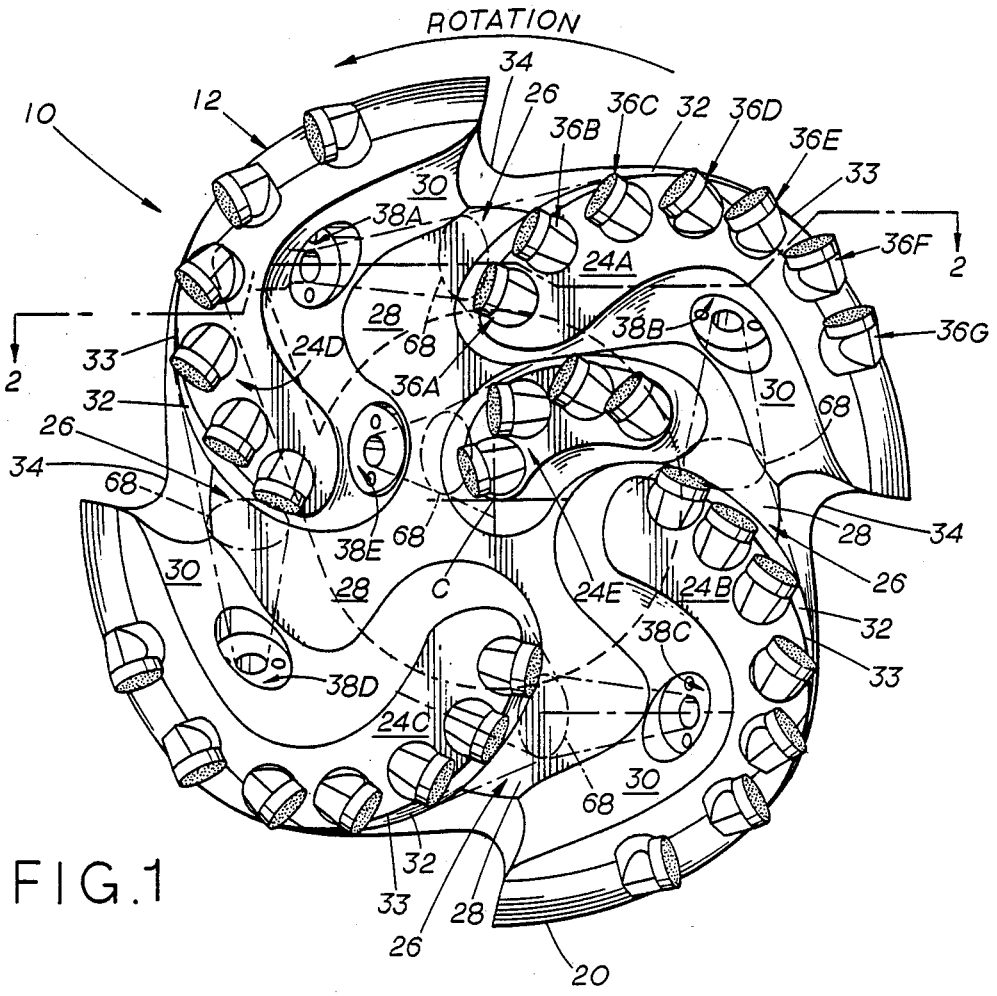
FIG. 1 is a bottom plan of the drag drill bit forming this invention and illustrating rows of cutting elements projecting from the outer face thereof.
Figure 3:
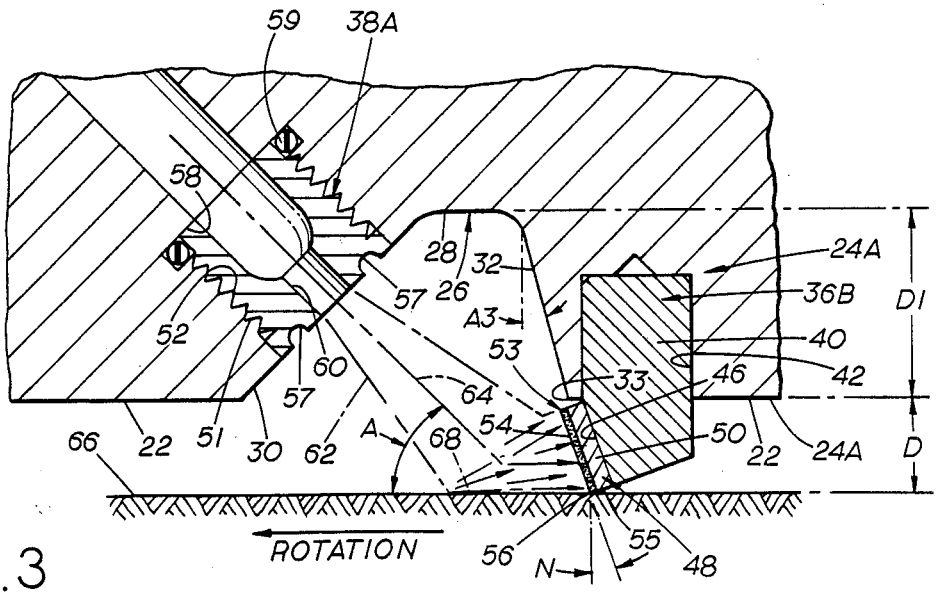
FIG. 3 is an enlarged fragment of FIG. 2 showing a discharge nozzle and associated cutting element with the centerline of the fluid jet or stream from the nozzle impinging the well bore bottom ahead of the cutting element with respect to the rotation of a drill bit.
Figure 2:
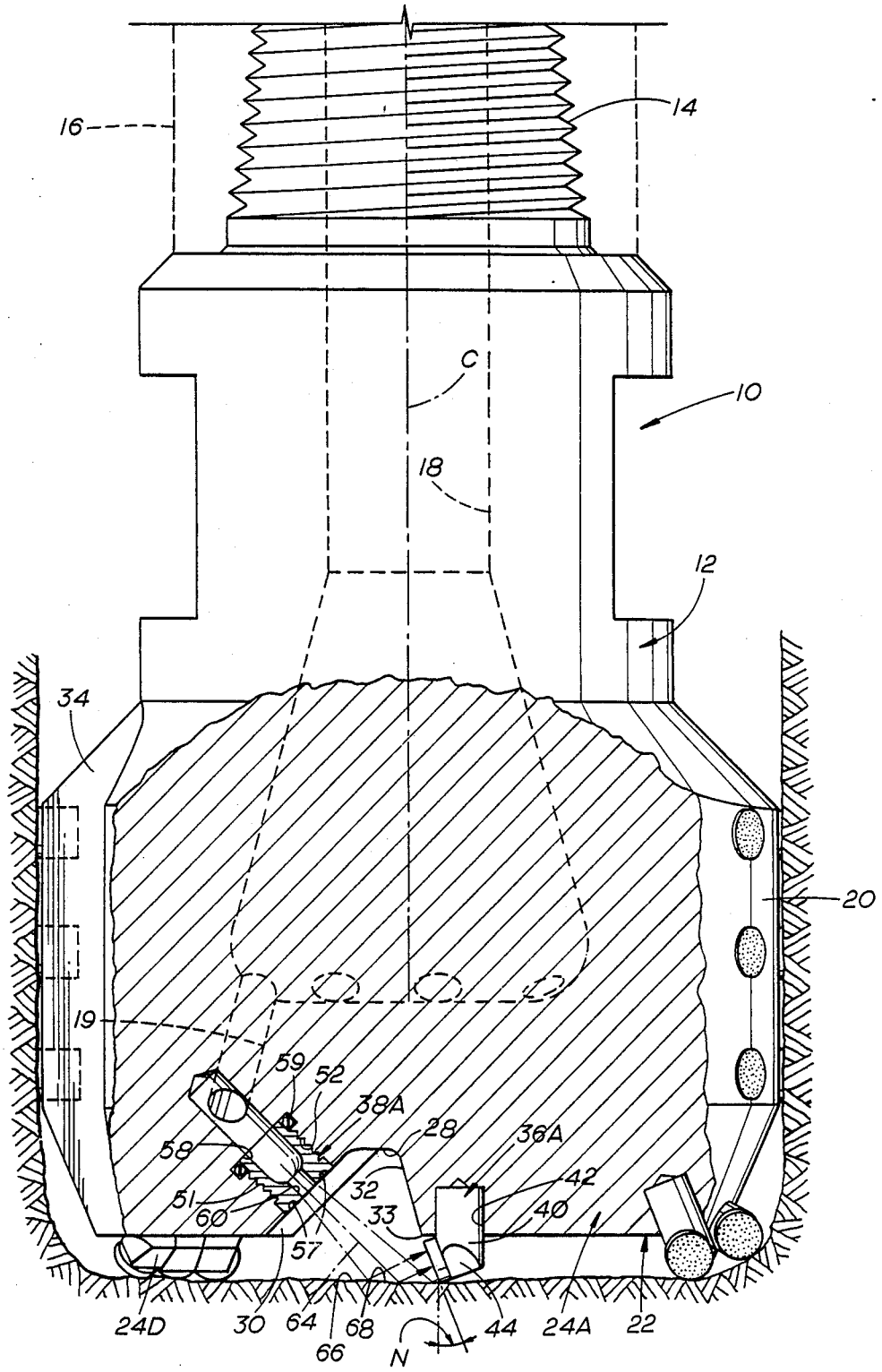
FIG. 2 is a section taken generally along line 2—2 of FIG. 1 but showing the drill bit partly in elevation.

Referring particularly to FIGS. 1–3, a drag type rotary drill bit is shown generally at 10 having a generally cylindrical bit body 12 with an externally threaded pin 14 at its upper end. Pin 14 is threaded within the lower end of a drill string indicated generally at 16 which is suspended from a drill rig at the surface for rotating drill bit 10. Drill bit body 12 has a longitudinally extending main fluid passage 18 which is adapted to receive drilling fluid or mud from the drill rig for the drilling operation and a branch line 19 leads from passage 18. Bit body 12 has an outer peripheral surface 20 forming the outer gage thereof and a lower face or surface 22 which forms a suitable crown. It is to be understood that bit body 12 can be formed with various types of crown designs for the face of the bit body depending for example, on such factors as the type of formation or the mud program proposed for the formation. Bit body 12 may be formed of any suitable material, such as various types of steel or cast tungsten carbide.

The lower face or crown 22 of bit body 22 is formed by a plurality of projecting curved blades or projections 24A, 24B, 24C, 24D, and 24E. Curve or spiral blades 24A–24E extend from the center of the axis of rotation located at C and their lowermost surfaces or faces 22 define the crown. Grooves generally indicated at 26 are formed between adjacent blades 24A–24E and provide channels for the flow of cuttings and drilling fluid. Grooves 26 define bottom surfaces at 28, sloping side surfaces 30 extending between bottom surfaces 28 and the respective associated blades 24A–24D, and side surfaces 32 extending between bottom surfaces 28 and the lowermost surface of blades 24A–24E defined by the crown at 22. The crown or lowermost surfaces 22 of blades 24A–24E extend between and connect side surfaces 30,32 of adjacent grooves 26. Blades 24A–24E extend in a generally spiral path with respect to the direction of rotation of drill bit 10. Side surfaces 32 define the leading faces of blades 24A–24E including leading edge 33. Junk slots 34 form a continuation of grooves 26 and are spaced around the outer peripheral surface 20 of drill bit body 12 to form passages for the upward flow of drilling fluid and cuttings from the bore hole.

Each blade 24A–24E has a plurality of associated cutting elements mounted thereon with the cutting elements on each blade being arranged and positioned in generally the same manner. For that reason, only the cutting elements mounted on blade 24A will be described in detail and are designated as 36A, 36B, 36C, 36D, 36E, 36F, and 36G. Similar cutting elements on the remaining blades are likewise designated successively from 36A.

A fluid discharge nozzle is provided for each of the blades and designated 38A, 38B, 38C, 38D, and 38E for respective blades 24A–24E. The positioning and functioning of each nozzle and the associated cutting elements are generally identical and for the purpose of illustration, only nozzle 38A and associated cutting elements 36A–36G on blade 24A will be explained in detail, it being understood that the remaining discharge nozzles and associated cutting elements are similarly positioned.

Cutting elements 36A-36G are staggered rearwardly in successive order with respect to the direction of rotation of drill bit 10. Thus, each cutting element from element 36A to cutting element 36G is spaced progressively farther from the associated nozzle 38A. Also, cutting elments 36A-36G are spaced radially outwardly from each other with the radial distance between the cutting elements decreasing from the axis of rotation. As shown particularly in FIGS. 5 and 6, the increasing number of cutting elements 36A–36G in a radial direction from the axis of rotation is illustrated. Also, the overlapping rotational paths of the cutting elements 36A–36G are shown diagrammatically in FIG. 6 with the rotational path of cutting element 36F being only slightly radially inward of the rotational path of cutting element 36G.

Figure 5:
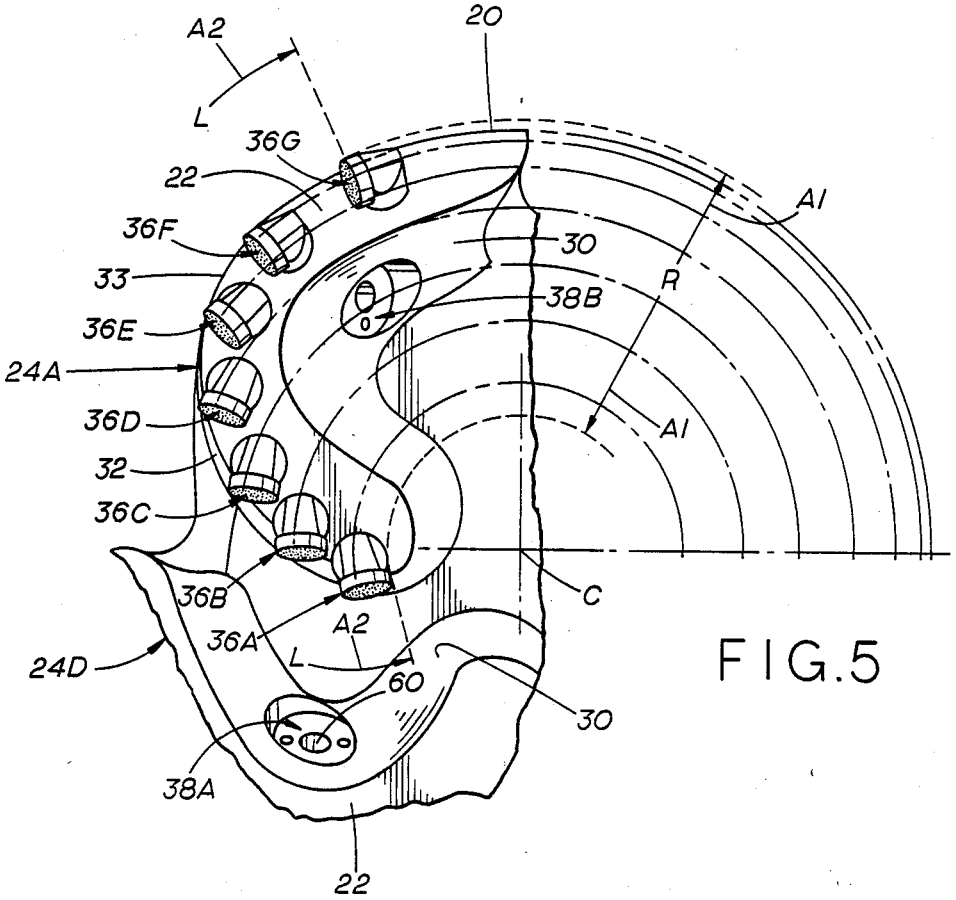
FIG. 5 is a fragmentary bottom plan of a row of cutting elements and the associated fluid discharge nozzle.
Figure 6:
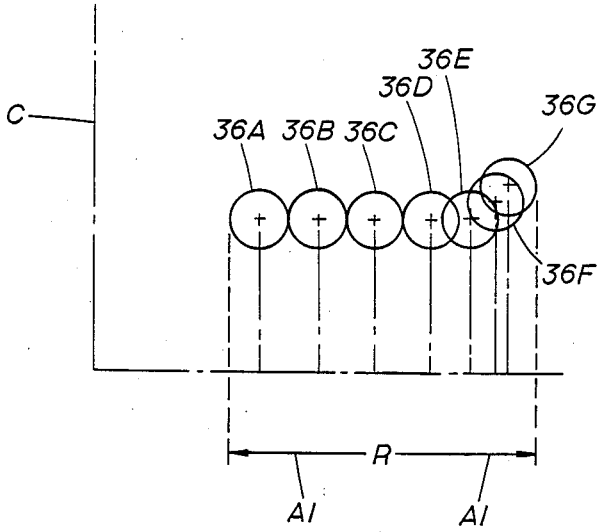
FIG. 6 is a graphical representation of the row of cutters shown in FIG. 5 arranged on a single radius and illustrating the lateral overlapping thereof.

As shown on FIGS. 5 and 6, the increased or maximum number of cutting elements on blade 24A is obtained by an increased length of blades 24A on which to mount the cutting elements. By having curved blade 24A formed in an outward spiral, an increased length of blade 24A is provided for a particular radial distance, shown at R as measured between arrows A1. The length of blade 24A between cutting element 36A and 36G as measured at L between arrows A2 along the arcuate leading face 32 of blade 24A is around twice the radial distance R for best results. It is believed that satisfactory results may be obtained by having a large number of cutting elements within a relative small radial distance if length L is at least forty (40) percent greater than the radial distance R. Around one-half ($\frac{1}{2}$) of the length L of blade 24A is positioned closely adjacent the outer periphery 20 of bit body 12 to provide a relatively long length mounting area for the cutting elements adjacent outer periphery 20. However, it is believed that satisfactory results may be obtained by having at least one-third ($\frac{1}{3}$) the length L of blade 24A generally closely adjacent the outer periphery 20 of the bit body 12 for providing the relatively large mounting area. Cutting element 36G along with cutting elements 36E and 36F are positioned adjacent or closely adjacent the outer periphery of bit body 12.

Each PDC cutting element 36A–36G is substantially identical and as shown particularly in FIG. 3, cutting element 36B comprises a stud 40 preferably formed of a hardened tungsten carbide material. Stud 40 fits within an opening 42 in blade 24A and is secured therein by an interference fit or by brazing, for example. Stud 40 has a tapered outer surface as shown at 44 in FIG. 2 and a planar leading surface 46 on which a generally cylindrical disc 48 is secured, such as by brazing. Disc 48 includes a base 50 formed of tungsten carbide, for example and having a cutting face 53 thereon defined by an outer diamond layer at 54. A lower arcuate surface 55 is defined by disc 48 and a cutting edge 56 is formed at the juncture of planar face 53 and arcuate surface 55. Disc 48 with the diamond face and tungsten carbide base, as well known in the art, is manufactured by the Speciality Material Department of General Electric Company at Worthington, Ohio and sold under the trademark "Stratapax".

As shown in FIG. 3, it is desirable that disc 48 have a negative rake or be inclined with respect to the direction of rotation of drill bit 10. A negative angle N of around twenty (20) degrees has been found to be satisfactory for most formations encountered. It is believed that a negative rake of between around five (5) degrees and around thirty-five (35) degrees will function adequate for a polycrystalline diamond face or a natural diamond face.

Figure 4:
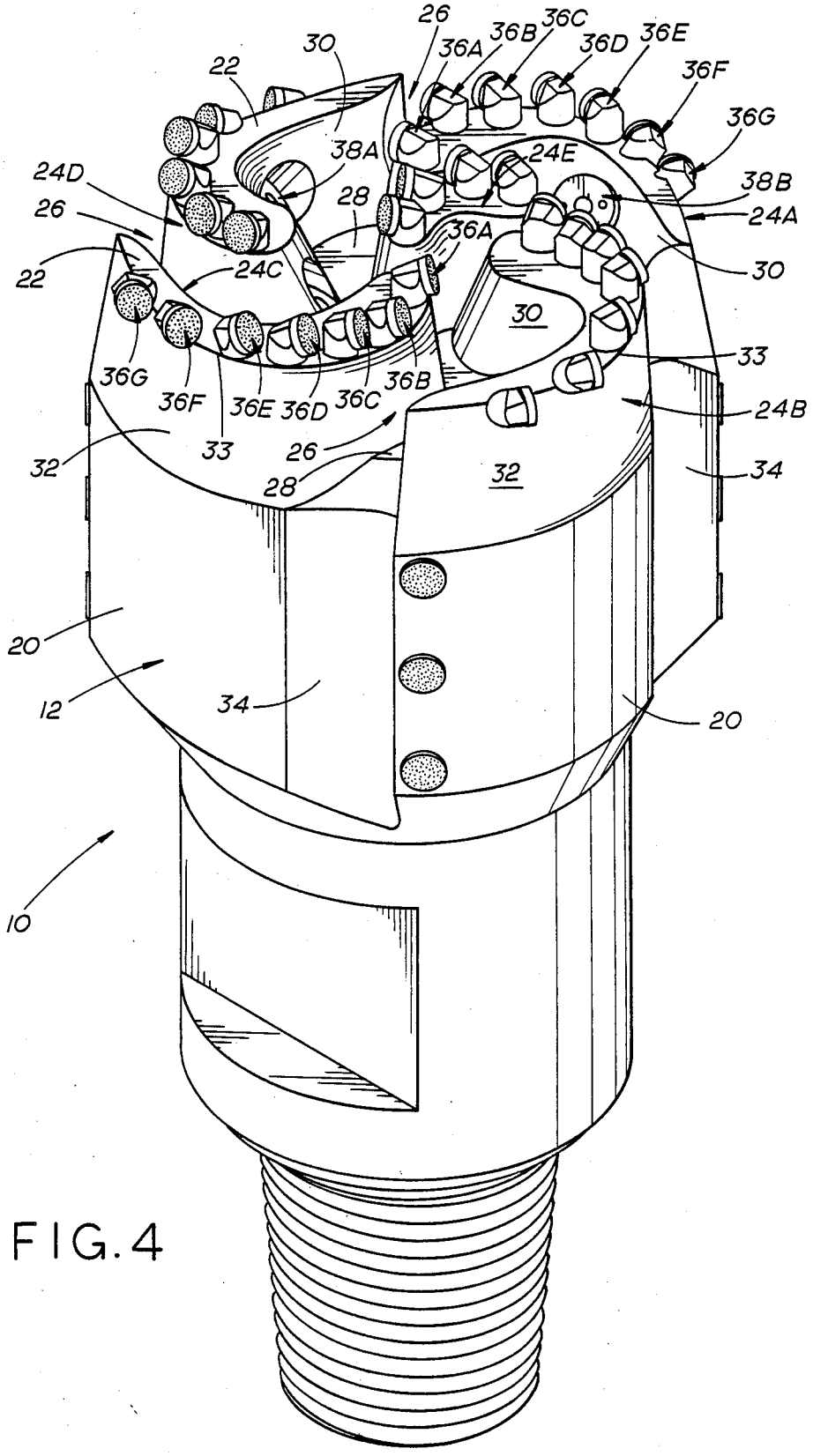
FIG. 4 is a perspective of the drill bit of FIGS. 1–3 illustrating particularly the blades and relatively deep grooves adjacent the blades.

Referring now particularly to FIGS. 3 and 4, the relatively large depth and width of grooves 26 relative to the cutting elements are illustrated. By having a relatively small number of blades with adjacent grooves 26 being relatively wide and deep, a highly effective flow of drilling fluid and entrained cuttings outwardly to the outer periphery 20 of drill bit 10 is obtained during the cutting operation. Cutting face 53 and cutting edge 56 of disc 48 project a distance D from the lowermost face of surface 22 of blade 24A formed by the crown of drill bit 10. The depth of groove 26 from the blade surface 22 is illustrated at D1 and as shown in FIG. 3 the depth of groove 26 inwardly from surface 22 shown at D1 is around three (3) times the projection D of cutting face 53 outwardly from surface 22. The depth of groove 26 shown at D1 should be at least around one-half ($\frac{1}{2}$) inch and at least around two (2) times the projection D of cutting face 53 from the lowermost surface 22 of blade 26. The width of each blade at the crown is the width of the lowermost surface of the respective blade, and as shown in FIGS. 1 and 4 is less than the width of adjacent grooves 26 at the crown. The width of each groove is wider than the width of each blade measured on a line which is perpendicular to a line tangent at a leading edge (33) of each blade. This measured line extends across the groove to the trailing side of the adjacent blade at the crown.

Leading blade surface 32 defining groove 26 is preferably arranged at an angle A3 generally similar to the negative rake N of associated discs 48 which is preferably around twenty (20) degrees with respect to the rotational axis R of drill bit 10, and not greater than around thirty-five (35) degrees. Leading edge 33 defined by leading surface 32 of blade 24 is shown in FIG. 3 as spaced slightly vertically from and in substantial vertical alignment with the adjacent planar surface 53 of associated disc 48. Surface 32 is shown as in a plane generally parallel to the plane formed by planar surface 53 defined by negative rake angle N and for best results should not deviate more than around thirty (30) degrees from angle N. For best results, leading edge 33 should not be spaced ahead of planar surface 53 with respect to the direction of rotation more than the thickness of disc 48 in order to provide a smooth continuous flow of cuttings from discs 48 into groove 26 and then laterally outwardly for discharge from the bore hole. Discs 48 are normally of a thickness between around one-sixteenth (1/16) inch to one-fourth ($\frac{1}{4}$) inch.

Surface 30 defines an opposed side of groove 26 and the trailing surface of an adjacent blade 24D. Surface 30 receives nozzle 38A which provides drilling fluid for the row of cutting elements 36A–36G on blade 24A. Surface 30 is shown as arranged at an angle of around forty-five (45) degrees with respect to the longitudinal axis of drill bit 10 but may be of any desired angle for accommodating the mounting of associated nozzle 38A.

Fluid discharge nozzle 38A is formed of a tungsten carbide material and is externally threaded at 51 for being screwed within an internally threaded opening 52. Openings 57 in the face of nozzle 38A as shown in FIGS. 2 and 3 are adapted to receive a suitable tool for securing nozzle 38A within threaded opening 52 for abutting engagement with annular shoulder 58. A resilient O-ring 59 is provided between nozzle 38A and bit body 12.

Nozzle 38A defines a fluid discharge orifice 60 which may be circular or oval in shape to provide a laterally divergent stream or jet of fluid shown generally at 62. The centerline of the jet of fluid being discharged from orifice 60 is shown at 64 and the perimeter of the area of fluid impingement against the bore hole bottom illustrated at 66 is shown at 68 as illustrated particularly by FIG. 3. The area of inpingement 68 is ahead of cutting elements 36A–36G with respect to the rotation of drill bit 10. After the fluid impinges or strikes well bore bottom 66, the major flow of drilling fluid is along the well bore bottom in a direction generally perpendicular or normal to the direction of rotation and to the planar cutting faces 53 of cutting elements 36A–36G. This causes the high energy fluid to impinge and clean cutting faces 53. Also, after impingement against well bore bottom 66, the fluid stream fans or diverges outwardly toward the periphery 20 of drill bit body 12 so that the cutting elements 36A–36G have their cutting faces 53 cleaned with the drilling fluid flowing opposite the direction of rotation of bit 10. The flow of fluid then continues along grooves 26 and then upwardly along junk slots 34 along with the cuttings.

By impinging bore hole bottom 66 immediately ahead of cutting elements 36A–36G the bottom is flushed or cleaned of cuttings from the drilling operation immediately before the cutting operation. Further, since only a small number of nozzles, such as five, for example, are utilized, a relatively high velocity of drilling fluid at a relatively high pressure is discharged from orifices 60 to provide an efficient scouring and flushing of the well bore bottom 66 immediately ahead of the cutting elements and to cause a high energy fluid to impinge the faces of the cutting elements. For best results and to permit discharge orifices 60 to be of a relatively large size so that clogging of the orifices is minimized, it has been found that the number of discharge nozzles should be limited to around eight or less dependent of the diameter of drill bit 10 and that each discharge nozzle should be associated with at least four (4) spacedcutting elements and as many as around ten (10) cutting elements. For example, with a bit diameter of around eight (8) inches around four (4) to five (5) blades would be utilized with one nozzle for each blade.

The stream of fluid is directed against the direction of rotation in order to provide after initial impingement of bottom 66 a desired high velocity flow of drilling fluid along bore hole bottom 66 against the cutting faces 53 of cutting elements 36A–36G. The stream or jet of drilling fluid must be directed against the direction of rotation of drill bit 10 to provide a flow of pressurized fluid for scouring the bottom immediately ahead of the cutting elements and to provide adequate cleaning and cooling action along the faces 53 of the cutting elements. Referring particularly to FIG. 3, an angle indicated at A is formed between the centerline 64 of the jet of fluid discharged from orifice 60 and the bore hole bottom 66 in a direction opposite the direction of rotation of the bit to provide a maximum utilization of fluid energy and dispersion of the fluid after impingement as it flows along the well bore bottom toward the faces of the cutting elements 36. An angle A of around forty-five (45) degrees has been found optimum with an optimum range between thirty (30) and sixty (60) degrees under most operating conditions for best results. However, it is believed that under various operating conditions, an angle A of between around fifteen (15) degrees to seventy-five (75) degrees would function satisfactory, depending on such factors for example as the size and type of bit, the number of discharge orifices, the number of cutting elements covered by a single discharge nozzle, and the type of formation encountered.

Any reference in the specification and claims herein to the centerline of the jet or stream of drilling fluid being discharged from a nozzle or orifice and impinging the bore hole bottom at an angle shall be interpreted as referring to angle A which represents the angle that the centerline of the volume of the discharged fluid stream from orifice 60 makes with the well bore hole bottom 66 in a direction opposite the direction of rotation of the bit.

From the above arrangement of cutting elements on long length arcuate blades defining deep grooves adjacent the blades, an improved flow of drilling fluid and entrained cuttings outwardly to the outer periphery of the drill bit has been provided resulting in a highly effective cutting operation as well as an effective scouring or cleaning of the bore hole bottom immediately prior to engagement of the formation by the cutting elements thus resulting in an increased rate of penetration.

While preferred embodiments to the present invention have been illustrated in detail, it is apparent that modification and adaptation of the preferred embodiment will occur to those skilled in the art. However, it is to be expressly understood that such modification or adaptations are within the spirit and scope of the present invention as set forth in the following claims.

What is claimed is:

1. A rotary drill bit of the drag type for drilling a bore hole in an earth formation comprising:

a generally cylindrical bit body having a fluid passage therein adapted to be connected to a drill string for rotation therewith about a longitudinal axis and to receive drilling fluid from said drillstring;

a plurality of blades on the bit body extending in a generally spiral pattern from adjacent the center of the bit body to the outer periphery thereof and separated from each other by deep grooves;

each blade having a curved leading side with respect to the direction of rotation extending generally to the outer periphery of the generally cylindrical bit body, a curved trailing side spaced from said leading side, and an outer surface connecting said leading and trailing sides to define the lower surface and crown of the bit body, said outer surface providing a relatively long length mounting area thereon for cutting elements;

each of said deep grooves extending between opposed leading and trailing sides of adjacent blades and defining a bottom between said opposed sides for forming a leading deep groove and a trailing deep groove for each blade;

a continuous row of cutting elements mounted in radially spaced relation along the length of the outer surface of each blade, each cutting element having a cutting face with substantially the entire cutting face projecting outwardly from the crown of the bit at a position closely adjacent the leading side of the associated blade, thereby to take a relatively large bite in the adjacent formation being cut, the depth of the leading groove measured from said bottom of each groove to said crown on a line parallel to the axis of rotation for each blade adjacent the cutting faces thereof being at least twice the projection of the cutting faces from the crown of the bit; and at least one fluid discharge orifice for high velocity drilling fluid associated with each blade for cleaning and cooling associated cutting faces on said blade with the cuttings being directed into the associated leading groove and flowing generally outwardly with the drilling fluid along the deep grooves adjacent said blades.

2. The rotary drill bit is set forth in claim 1 wherein the length of said curved leading side of each blade is at least forty percent greater than the radial distance covered by said blade with around one-half the length of said curved leading side being positioned generally adjacent the outer periphery of the bit body.

3. The rotary drill bit as set forth in claim 1, wherein the number of cutting elements for each blade increases for specific radial distance form the axis of rotation to the outer periphery of the bit body.

4. The rotary drill bit as set forth in claim 1, wherein each cutting element has a polycrystalline diamond cutting face.

5. A rotary drill bit of the drag type for drilling a bore hole in an earth formation comprising:

a generally cylindrical bit body having a fluid passage therein adapted to be connected to a drill string for rotation therewith about a longitudinal axis and to receive drilling fluid from said drillstring;

a plurality of blades on the bit body extending in a generally spiral pattern from adjacent the center of the bit body to the outer periphery thereof and separated from each other by deep grooves;

each blade having a curved leading side with respect to the direction of rotation extending generally to the outer periphery of the generally cylindrical bit body, a curved trailing side spaced from said leading side, and an outer surface connecting said leading and trailing sides to define the lower surface and crown of the bit body;

each of said deep grooves defining a bottom surface extending between opposed leading and trailing sides of adjacent blades and defining a bottom between said opposed sides for forming a leading deep groove and a trailing deep groove for each blade;

a continuous row of cutting elements mounted in radially spaced relation along the length of the outer surface of each blade, each cutting element having a cutting face with substantially the entire cutting face projecting outwardly from the crown of the bit at a position closely adjacent the leading side of the associated blade, thereby to take a relatively large bite in the adjacent formation being cut, the depth of the leading groove measured from said bottom of each groove to said crown on a line parallel to the axis of rotation for each blade adjacent said cutting faces being at least twice the projection of the cutting faces from the crown of the bit; and at least one fluid discharge nozzle in said bit body associated with each blade and directing a high velocity drilling fluid against the formation with the cuttings being directed into the associated deep groove and flowing generally outwardly with the drilling fluid along the deep grooves adjacent said blades;

each nozzle for a respective row of cutting elements directing the fluid under pressure to flow opposite the direction of rotation of the bit and in a generally downward, conical flow pattern stream to an area of impingement on the well bore bottom ahead of the respective row of cutting elements, with the fluid flowing from the area of impingement in a lateral divergent stream generally along said deep grooves, whereby the portion of the well bore bottom immediately in the path of the cutting faces is cleaned of cuttings, and the cutting faces are thereafter washed clean of cuttings and adequately cooled by the stream of drilling fluid as the cutting are formed, for enhanced drill bit rates of drilling penetration.

6. The rotary drill bit is set forth in claim 5 wherein the length of said curved leading side of each blade is at least forty percent greater than the radial distance covered by said blade with around one-half the length of said curved leading side being positioned generally adjacent the outer periphery of the bit body.

7. The rotary drill bit as set forth in claim 5 wherein the number of cutting elements for each blade increases for a specfic radial distance from the axis of rotation to the outer periphery of the bit body.

8. The rotary drill bit as set forth in claim 5 wherein each cutting element has a polycrystalline diamond cutting face.

9. The rotary drill bit as set forth in claim 5 wherein said fluid discharge nozzle for each blade is positioned within the trailing side of an immediately preceding blade with respect to the direction of rotation and directs high velocity drilling fluid across the deep leading groove for said blade against the cutting elements thereof.

10. A rotary drill bit of the drag type for drilling a bore hole in an earth formation comprising:

a bit body having a fluid passage therein adapted to be connected to a drill string for rotation therewith about a longitudinal axis and to receive drilling fluid from said drillstring;

a plurality of blades along the lower surfaces of the bit body extending in a generally spiral pattern from adjacent the center of the bit body to the outer periphery thereof;

each blade having a curved leading side with respect to the direction of rotation extending generally to the outer periphery of the bit body, a curved trailing side spaced from said leading side, and an outer surface connecting said leading and trailing sides to define the lower surface and crown of the bit body for mounting cutting elements thereon;

said bit body having a deep groove between each pair of adjacent blades with each groove defining a bottom connecting opposed leading and trailing sides of adjacent blades thereby to form a leading deep groove and a trailing deep groove for each blade;

a continuous row of cutting elements mounted in radially spaced relation along the outer surface of each blade, each cutting element having a cutting face projecting outwardly from the crown of the bit at a position closely adjacent the leading side of the associated blade and adjacent the associated leading groove for such blade so that cuttings therefrom are directed into the associated leading deep groove, the width of said leading deep groove being greater than the width of said blade at the crown at a location intermediate the length of said blade as measured on a line which is perpendicular to a tangent along the leading side of said blade at said crown and extends across said groove to the trailing side of the adjacent blade at said crown; and at least one fluid discharge nozzle in said bit body associated with each blade and directing a high velocity drilling fluid against the formation with the cuttings being directed into the associated deep groove and flowing generally outwardly with the drilling fluid along the deep grooves adjacent said blades;

each nozzle for a respective row of cutting elements directing the fluid under pressure to flow opposite the direction of rotation of the bit and in a generally downward, conical flow pattern stream to an area of impingement on the well bore bottom ahead of the respective row of cutting elements, with the fluid flowing from the area of impingement in a lateral divergent stream generally along said deep grooves, whereby the portion of the well bore bottom immediately in the path of the cutting elements is cleaned of cuttings, and the cutting elements are thereafter washed clean of cuttings and adequately cooled by the stream of drilling fluid as the cuttings are formed for enhanced drill bit rates of drilling penetration.

11. The rotary drill bit as set forth in claim 10 wherein the number of cutting elements for each blade increases for a specific radial distance from the axis of rotation to the outer periphery of the bit body.

12. The rotary drill bit as set forth in claim 10 wherein around one-half the length of said curved leading side is positioned generally adjacent the outer periphery of the bit body to provide a relatively long mounting area thereat for cutting elements.

* * * * *